US009470099B2

(12) United States Patent
Stanka et al.

(10) Patent No.: US 9,470,099 B2
(45) Date of Patent: Oct. 18, 2016

(54) SECURING DEVICE FOR AXIALLY SECURING A BLADE ROOT OF A TURBOMACHINE BLADE

(75) Inventors: Rudolf Stanka, Rattenkirchen (DE); Manfred Dopfer, Unterschleissheim (DE); Martin Pernleitner, Dachau (DE); Wilfried Schuette, Oberhaching (DE)

(73) Assignee: MTU Aero Engines GmbH, Munich (DE)

( * ) Notice: Subject to any disclaimer, the term of this patent is extended or adjusted under 35 U.S.C. 154(b) by 697 days.

(21) Appl. No.: 13/885,045

(22) PCT Filed: Nov. 11, 2011

(86) PCT No.: PCT/DE2011/001985

§ 371 (c)(1),
(2), (4) Date: Jun. 12, 2013

(87) PCT Pub. No.: WO2012/065599

PCT Pub. Date: May 24, 2012

(65) Prior Publication Data

US 2013/0251532 A1 Sep. 26, 2013

(30) Foreign Application Priority Data

Nov. 15, 2010 (DE) ..... 101 91 240

(51) Int. Cl.

| | |
|---|---|
| ***F01D 5/30*** | (2006.01) |
| ***F01D 5/26*** | (2006.01) |
| ***F01D 5/32*** | (2006.01) |

(52) U.S. Cl.

CPC ..... *F01D 5/3007* (2013.01); *F01D 5/26* (2013.01); *F01D 5/3092* (2013.01); *F01D 5/323* (2013.01); *F05D 2250/71* (2013.01); *F05D 2300/501* (2013.01)

(58) Field of Classification Search

CPC .... F01D 5/3007; F01D 5/323; F01D 5/3092; F01D 5/26; F01D 5/16; F01D 5/326; F05D 2300/501; F05D 2250/71; F05D 2260/96

See application file for complete search history.

(56) References Cited

U.S. PATENT DOCUMENTS

| | | | | |
|---|---|---|---|---|
| 3,936,234 A * | 2/1976 | Tucker | F01D 5/323 416/220 R |
| 4,102,602 A | 7/1978 | Rottenkolber | |
| 5,123,813 A * | 6/1992 | Przytulski | F01D 5/26 403/372 |

(Continued)

FOREIGN PATENT DOCUMENTS

| | | |
|---|---|---|
| DE | 26 39 200 | 3/1978 |
| DE | 43 00 773 | 11/1993 |

(Continued)

*Primary Examiner* — Dwayne J White
*Assistant Examiner* — Adam W Brown
(74) *Attorney, Agent, or Firm* — Davidson, Davidson & Kappel, LLC

(57) ABSTRACT

A securing device (20) for axially securing a blade root (12) of a blade in a groove (11) of a turbine engine. The outer contour (24) of the securing device (20) that faces a groove wall, in particular a groove base (33), is curved at least in some regions, the outer contour (24) having three different radii (R1, R2, R3) in some regions.

13 Claims, 1 Drawing Sheet

(56) References Cited

U.S. PATENT DOCUMENTS

| | | | | |
|---|---|---|---|---|
| 5,425,621 | A | 6/1995 | Maar | |
| 5,584,659 | A | 12/1996 | Schmidt | |
| 6,582,195 | B2 * | 6/2003 | Davidson | F01D 5/30 416/198 A |
| 6,773,234 | B2 * | 8/2004 | Sinha | F01D 5/3007 29/889.21 |
| 2004/0076523 | A1 | 4/2004 | Sinha | |
| 2005/0207892 | A1 | 9/2005 | Kanebako et al. | |
| 2009/0004017 | A1 | 1/2009 | Belmonte et al. | |
| 2010/0189564 | A1 * | 7/2010 | Stone | F01D 5/3092 416/221 |

FOREIGN PATENT DOCUMENTS

| | | |
|---|---|---|
| DE | 44 30 636 | 3/1996 |
| DE | 198 23 157 | 11/1999 |
| DE | 10 2005 008509 | 9/2005 |
| EP | 2 009 245 | 12/2008 |
| FR | 2 937 370 | 4/2012 |
| WO | WO 96/41068 | 12/1996 |

* cited by examiner

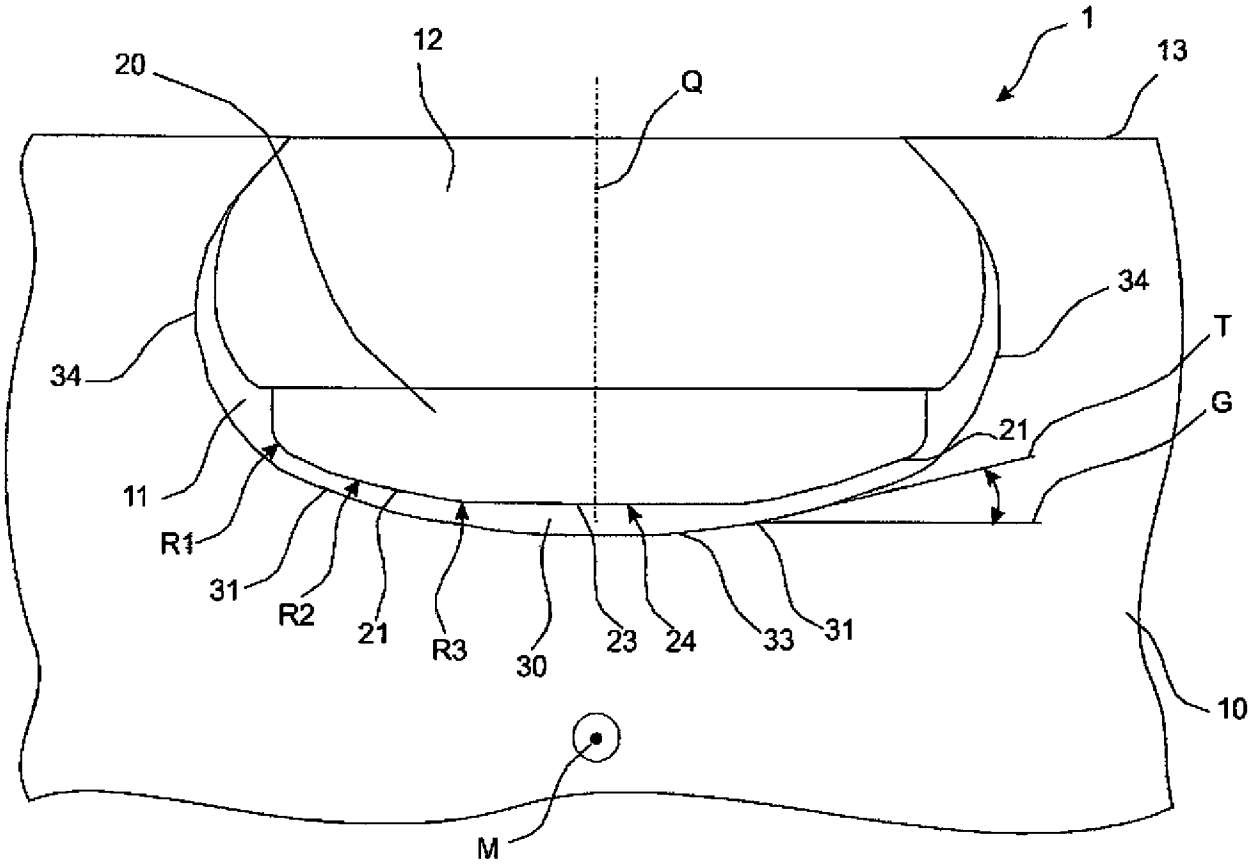
1
13
34
T
G
10
21
31
33
24
23
30
Q
12
R3
21
R2
31
R1
11
20
34
M

SECURING DEVICE FOR AXIALLY SECURING A BLADE ROOT OF A TURBOMACHINE BLADE

The present invention relates to a securing device for axially securing a blade root of a turbine engine blade, as well as to a turbine engine having such a securing device.

BACKGROUND

From the related art, it is generally known to mount rotor blades on a rotor in the axial direction of the rotor. To this end, a blade root of the blade is inserted into a groove provided in the rotor that extends in the axial direction of the rotor. The blade must be secured radially and axially relative to the rotor axis, in order to limit, respectively prevent a shaking, respectively vibratory movement of the blades, in particular upon start-up of the turbine engine. Such a shaking, respectively vibratory movement can cause surface damage to the rotor and/or to the blades, thereby shortening the service life of the turbine engine and degrading the efficiency during operation.

The German Patent DE 44 30 636 C2 describes a turbine engine having a blade and an axial groove in the rotor. The blade has a blade root in the shape of a fir tree. The blade root of the blade is inserted into the correspondingly shaped axial groove. The configuration of the blade root allows the blade to be radially secured relative to the rotor axis. A securing plate is provided in the axial groove between the blade root and the rotor. At the ends thereof, the securing plate has folding tabs for securing the blades in the axial direction. In the cross section normal to the axis, the securing plate has a rounded shape.

Such securing plates are known from U.S. Patent Application 2004/076523 A1 and European Patent Application EP 2 009 245 A1. In the figures, each of these has two radii, between which a concave portion is disposed that cannot come into contact with the groove.

A disadvantage associated with the known securing element is that the area of contact between the securing plate and the groove is small. Thus, a groove wall and/or a securing plate can become damaged when the force transmitted by the blade and the securing plate to the groove wall becomes substantial. A force of this kind can arise, for example, when a vibrating blade strikes against the groove wall.

SUMMARY OF THE INVENTION

It is an object of the present invention to improve the axial securing of a blade.

The present invention provides a securing device for axially securing a blade root of a rotor blade in a groove of a rotor of a turbine engine. An outer contour of the securing device that faces the groove inner wall, in particular a groove base of the groove, is curved at least in some regions, the outer contour having different radii in some regions. By providing the outer contour with different radii, the contact region between the securing device and a groove wall may be optimized, in particular enlarged. The optimized contact region decreases the surface pressure on the groove wall, for example, in the event that the securing device strikes against the groove wall, thereby lessening the risk of damage to the groove wall and/or the securing device.

The groove wall is composed of the groove base and the groove sides. The groove sides are joined to the respective end of the groove base and extend from the groove base toward an outer rotor side. Along the lines of the present invention, the securing-device contact region is understood to be the region of the outer contour of the mounted securing device that may be brought into contact with a groove contact region. Accordingly, in accordance with the present invention, the groove contact region is understood to be the region of the groove wall that may be brought into contact with the securing-device contact region. The groove contact region may be provided in the groove base and/or at the groove side. The contact region is described as the region between the securing device and the groove wall that results upon a contacting of the securing device and the groove wall.

A turbine engine, which has a securing device according to the present invention, may be a gas or steam turbine, in particular, and preferably an aircraft engine. A plurality of grooves are introduced that are distributed over the periphery of the rotor and, in particular, may each extend in one axial direction of the rotor. The blade may have a blade leaf and a blade root, and is fixedly anchored in position radially relative to the rotor axis via the blade root in a blade-root fastening region of the groove of the rotor. The blade roots may preferably have a fir tree-, dovetail- or hammerhead-like geometry. The grooves may preferably have an elliptical, circular or other shape in the cross section normal to the axis of a groove region, which, in the radial direction, is more proximate to the rotor axis than is the blade-root fastening region.

The securing device may be adapted to the groove, respectively configured therein in a way that allows a gap to form between the outer contour of the mounted securing device and the groove wall, in particular the groove base. At the side thereof facing the blade root, the securing device may be joined to a side of the blade root facing the securing device. Configuring the securing device in the groove in this manner advantageously allows a cooling of the blade root and/or of the groove.

In accordance with the present invention, the outer contour of the securing device has three or more different radii that are selected in such a way that the area of contact between the securing device and the groove wall is enlarged, one radius being selected to be greater than the two other radii. One section of the outer contour having the largest radius is preferably configured to be longer than the remaining sections of the outer contour. In accordance with the present invention, the section having the largest radius is configured between the two other sections.

Providing an outer contour with three radii, respectively sections configured in this manner makes it possible to ensure a large area of contact between the securing device and the groove wall. This reduces the risk of damage to the securing device and/or the groove wall, as caused by a nicking due, for example, to a high surface pressure in the event of a striking of the securing device against the groove wall. The service life of the turbine engine is thereby increased.

One advantageous embodiment of the present invention additionally provides that the securing device, which may be in the form of a securing plate, for example, may have a radius in one section of the outer contour that essentially has the same value as a radius of the groove contact region. For the case that the groove has an elliptical or other shape with a varying radius of curvature in the cross section normal to the groove axis, the radius of the groove contact region is understood, in particular, to be an average radius of curvature value of the groove contact region. The section of the outer contour of the securing element that has the same radius as the groove contact region may advantageously be the section of the outer contour that has the largest radius and is longer than the other section(s). By dimensioning the radii of the section of the securing device and of the groove contact region in this manner, the particular section of the securing device and of the groove contact region may be optimally adapted to one another, thereby lessening the risk of damage to the groove contact region and/or the securing device.

In one preferred variant, at least two sections of the outer contour having different radii, may form the securing-device contact region. It is self-evident that a plurality of securing-device contact regions are provided in the outer contour of the securing. In one specific embodiment according to the present invention, the outer contour of the securing device facing the groove wall, in particular the groove base, may have two curved securing-device contact regions and one straight section. The two securing-device contact regions may be provided at opposite ends of the securing device relative to a securing device axis that extends transversely to the rotor axis. The straight section of the outer contour is configured between the two securing-device contact regions and is joined at the ends thereof to the respective securing-device contact region.

The individual securing-device contact regions in the outer contour may be configured to be identical or to differ from one another. Thus, in all of the securing-device contact regions, sections may be dimensioned to have the same or different lengths and/or radii. Thus, the particular securing-device contact region may be adapted to the configuration of the groove wall. The securing-device contact region may be advantageously adjusted in a way that increases the area of contact between the securing device and the groove wall.

In one advantageous variant, the at least one securing-device contact region is provided on the outer contour in a way that ensures that no self-locking of the securing device occurs upon a contacting of the securing device with the groove wall. To this end, the securing-device contact region is configured in an area of the outer contour that forms in a groove wall region located outside of a self-locking region in response to a contacting of the securing device with the groove wall of the groove contact region.

The groove contact region resides, in particular, outside of the self-locking region when an inclination angle between a tangent line at the groove wall and a straight line extending perpendicularly to a straight connecting line between the rotor axis and a groove center point is larger than the arc tangent of the friction coefficient in the area of contact. Avoiding a self-locking of the securing device in the groove advantageously prevents high forces in the securing device and thus in the blade root caused by a jamming of the securing device in the groove. The securing device can become jammed in the groove, for example, due to a change in the groove shape resulting from an expansion of the rotor in response to a temperature change.

Along the lines of the present invention, self-locking is understood to be the locking of the securing device by the friction between the securing device and the groove wall. No self-locking occurs when the static friction of the securing device is exceeded. The self-locking is substantially dependent on the previously mentioned inclination angle of the groove wall and a friction coefficient of the groove contact region. Thus, a self-locking is present when a tangent line at the groove wall forms an angle with the straight line that extends perpendicularly to the straight connecting line between the rotor axis and the groove center point, and the tangent of the angle is smaller than or equal to the friction coefficient.

The securing device may be composed of an elastic material and/or have an elastic region. The elastic region may be formed by an undulated configuration of the securing device in the axial direction of the rotor, for example. The elastic material and/or the elastic region, in particular the undulated configuration of the securing device, make it possible to damp the impact of the securing device in the case of a striking of the securing device against the groove wall. Moreover, at the ends thereof, the securing device may have folding fastening devices in the axial direction of the rotor, in particular one or more tabs. The fastening devices of the securing device may be used to readily ensure the axial securing of the blades.

BRIEF DESCRIPTION OF THE DRAWING

Further features and advantages of the present invention will become apparent from the dependent claims and the exemplary embodiment. For this, the only FIG. 1: shows a cut-away portion of a cross section of the rotor of a turbine engine having a groove and a securing device in accordance with one variant of the present invention.

DETAILED DESCRIPTION

One single one of grooves 11 configured side by side in the circumferential direction of a rotor 10 of turbine engine 1 is shown in the cut-away portion of a cross section of a turbine engine 1 illustrated in FIG. 1. Groove 11 extends in an axial direction of the rotor and is configured elliptically in the cross section normal to the groove axis in the region proximate to rotor axis M. Groove 11 features a groove wall that is composed of a groove base 33 and two groove sides 34. Groove sides 34 are joined to the respective end of groove base 33 and extend from groove base 33 toward an outer rotor side 13. Groove base 33 corresponds to the side of the ellipse having the largest radius of curvature.

Moreover, FIG. 1 shows a portion of a blade root 12 of a blade (not shown) that is at least partially configured in groove 11 and is joined to a blade leaf (not shown). A securing device 20 is provided in groove 11 between blade root 12 and rotor 10. At the side thereof facing blade root 12, securing device 20 is joined thereto in such a way that a gap 30 forms between outer contour 24 of securing device 20 facing groove base 33, and groove base 33.

At outer contour 24 thereof facing groove base 33, securing device 20 has two curved securing-device contact regions 21 and a straight section 23. Relative to a securing device axis Q, which extends transversely to a rotor axis M, securing-device contact region 21 is configured at opposite sides of securing device 20. Straight section 23 is provided between the two securing-device contact regions 21 and is joined at the ends thereof to the respective securing-device contact region 21.

Securing-device contact regions 21 each have three sections having different radii R1, R2, R3, a first section having a first radius R1, a second section having a second radius R2, and a third section having a third radius R3. Second radius R2 of the second section of securing-device contact region 21 corresponds to an average radius of curvature value of a groove contact region 31 of the groove wall that faces opposite corresponding securing-device contact region 21. Moreover, second radius R2 is larger than first and third radius R1, R3. The second section having radius R2 of securing-device contact region 21 is configured between the first section having radius R1 and third section having radius R3, and is configured to be longer than the first and second section of securing-device contact region 21.

The two securing-device contact regions 21 are configured at outer contour 24 of securing device 20 in such a way that they contact groove contact region 31 in one area of groove base 33 and/or of groove sides 34 that is located outside of a self-locking region of securing device 20. A contacting of groove base 33 and/or of groove sides 34 by securing device 20 may occur, for example, when the blades vibrate in the radial direction toward rotor axis M and/or if the groove shape changes in response to a temperature change, in particular temperature increase of rotor 10.

Groove contact region 31 resides in an area of groove base 33 and/or of groove sides 34 where an inclination angle $\alpha$ between a tangent line T of groove base 33, respectively of groove side 34 and a straight line G, which extends perpendicularly to a straight connecting line between the groove center point and rotor axis M, is greater than 30°. This prevents a self-locking since the arc tangent of the friction coefficient $\mu$=0.5 of the contact pairing of the securing device-groove wall is 30°.

What is claimed is:

1. A turbine engine comprising:

a rotor having a groove; and a securing device for axially securing a blade root of a blade in the groove, the securing device including a securing body with an outer contour facing a groove wall, the outer contour being curved and having different radii, the outer contour having a securing device contact region for contacting a groove contact region of the groove wall, an inclination angle between a tangent line of the groove wall and a straight line extending perpendicularly to a straight connecting line between a groove center point and a rotor axis is greater than an arc tangent of a friction coefficient between the securing device and the groove wall, an area of contact between the securing device and the groove wall being located outside of a self-locking region.

2. The turbine engine as recited in claim 1 wherein a first or third section of the outer contour having a first or third radius, respectively, is shorter than a second section of the outer contour having a second radius.

3. The turbine engine as recited in claim 1 wherein at least one of three radii corresponds to a wall radius of the groove wall.

4. The turbine engine as recited in claim 3 wherein the wall radius is at a groove base.

5. The turbine engine as recited in claim 3 wherein the wall radius is an average radius of curvature value of a groove contact region.

6. The turbine engine as recited in claim 3 wherein the at least one radii is the second radius.

7. The turbine engine as recited in claim 1 wherein the area of contact is between the securing device and a groove base of the groove wall.

8. The turbine engine as recited in claim 1 wherein the securing device is in the form of a securing plate.

9. The turbine engine as recited in claim 1 wherein the securing device is composed of an elastic material or has an elastic region.

10. The turbine engine as recited in claim 1 wherein the groove wall is a groove base.

11. A gas or steam turbine comprising the turbine engine as recited in claim 1.

12. The turbine engine as recited in claim 1 wherein the groove wall has three different radii including a first radius, a second radius and a third radius.

13. The turbine engine as recited in claim 12 wherein the second radius is configured between the first and a third radius and is larger than at least one of the first and third radii.

* * * * *